US007870842B2

(12) United States Patent
Decuir

(10) Patent No.: US 7,870,842 B2
(45) Date of Patent: Jan. 18, 2011

(54) ENGINE WITH DESMODROMICALLY ACTUATED ROCKER

(76) Inventor: Julian A. Decuir, P.O. Box 720801, Pinon Hills, CA (US) 92372

( * ) Notice: Subject to any disclaimer, the term of this patent is extended or adjusted under 35 U.S.C. 154(b) by 369 days.

(21) Appl. No.: 12/080,874

(22) Filed: Apr. 7, 2008

(65) Prior Publication Data

US 2009/0250030 A1 Oct. 8, 2009

(51) Int. Cl.
*F01L 1/30* (2006.01)

(52) U.S. Cl. ..... 123/90.24; 123/90.39

(58) Field of Classification Search ..... 123/90.24, 123/90.16, 90.39

See application file for complete search history.

(56) References Cited

U.S. PATENT DOCUMENTS 4,858,573 A 8/1989 Bothwell
6,053,134 A 4/2000 Linebarger
6,877,469 B2 * 4/2005 Lau ..... 123/90.24
6,945,206 B1 9/2005 Mobley
2008/0060596 A1 3/2008 Decuir

FOREIGN PATENT DOCUMENTS

GB 2166799 A 11/1984

* cited by examiner

*Primary Examiner*—Zelalem Eshete
(74) *Attorney, Agent, or Firm*—Stetina Brunda Garred & Brucker

(57) ABSTRACT

An engine comprising a valve, cam lobe, rocker, follower member and an optional spring is disclosed herein. The valve may comprise a valve stem. The cam lobe may have a base circle and a nose. The cam lobe may be attached to a rotating shaft. The rocker may have a valve end portion contacting the valve, a lifter end portion defining a pivot axis of the rocker and a cam surface disposed between the valve end portion and the lifter end portion. The nose of the cam lobe may contact the cam surface for opening the valve. The follower member may be disposed adjacent the cam lobe opposite the rocker. The follower member may be attached to the rocker and have a curved inner surface upon which the nose of the cam lobe contacts for lifting the rocker. The spring may be disposed about the valve stem of the valve for closing the valve stem of the valve.

13 Claims, 15 Drawing Sheets

ENGINE WITH DESMODROMICALLY ACTUATED ROCKER

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates to a valve and cam systems for internal combustion engines with intake and/or exhaust valves.

Most conventional internal combustion piston driven engines utilize valve trains to induct an air/fuel mixture into the cylinders and to expel the burned air/fuel mixture from the cylinders. Typically, each cylinder is assigned at least one intake valve and at least one exhaust valve. The valves are pushed down by rockers thereby opening the valve and pushed upwardly by springs thereby closing the valve. When the valve stem is pushed down by the rocker to open the valve, the spring is compressed. The valve is closed when the spring decompresses thereby pushing the valve stem up through the valve guide until the head of the valve is seated in the valve seat and pushing the rocker back upward. To close the valve, the spring works to move the mass of both the valve and the rocker. Hence, the spring must be a heavy duty spring to keep up with the cam lobe.

For example, in a typical four-stroke engine, an intake valve is opened by an intake rocker which receives an input force from an intake cam lobe while the piston goes down inducting an air/fuel mixture into the cylinder. This is known as the induction stroke. While the intake valve stem is being pushed down through an intake valve guide, an intake spring concentrically positioned around the intake valve stem is compressed. Next, the cam lobe continues to rotate allowing the intake spring to decompress. The intake spring pushes the intake valve back up through the intake valve guide and the rocker back upward until the intake valve is seated in the intake valve seat. The piston also moves back up the cylinder. At this point in the combustion process, the air/fuel mixture is compressed. This stage is known as the compression stroke. With both the intake and exhaust valves closed so that the combustion chamber is sealed tight, a spark is then produced by a spark plug which ignites the air/fuel mixture wherein the rapidly expanding hot gasses force the piston downward with great energy creating power. This is known as the power stroke. The exhaust valve is then opened by an exhaust rocker receiving input from an exhaust cam lobe. The piston moves up the cylinder and the exhaust valve expels the burned air/fuel mixture, also known as the exhaust stroke. The exhaust cam lobe continues to rotate and allows an exhaust spring to push the rocker back upward and the exhaust valve back to the closed position.

The aforementioned conventionally configured valve train system for opening and closing the valves have proven to be highly effective and reliable in the past. However, closing the valve by the force of the heavy duty spring does have some disadvantages. For example, the valve must be opened by pushing against the force of the heavy duty spring thereby consuming engine power. The springs are strong such that the valves will close in accordance with the profile of the cam lobe and before the cam lobe pushes the rocker to reopen the valve during its next cycle. Also, the valve springs are continuously pushing the valves closed and work must be performed to overcome such spring tension wasting energy that could be used to create output power. Another disadvantage is that because the cam mechanism cannot afford to have any "bounce" from the springs, the cam profile has to be somewhat gentle, i.e., it must gently push the valve, but never shove it. This means the valve must open slowly like a water faucet—not quickly like a light switch, for example. Another disadvantage is that when the motor is turned at high rpms, the valves can "float" and hit the piston. In other words, the spring does not traverse the valve back to the closed position fast enough such that the piston hits the valve. Valve float happens when the speed of the engine is too great for the valve spring to handle. As a result, the valves may stay open and/or "bounce" on their seats.

To overcome these disadvantages, innovative desmodromic valve trains have evolved over about the last century; however, in a very slow technological pace and in most applications with limited success. The term "desmodromic" arises from the two greek words: "desmos" (controlled or linked), and "dromos" (course or track). A desmodromic system is also known as a system that provides "positive valve actuation" wherein the strokes are "controlled." The desmodromic valves are those which are positively closed by leverage system or follower, rather than relying on the more conventional springs to close the valves.

Desmodromic valve trains have several advantages over conventional spring closed valve trains. A first major advantage is that in a desmodromic valve system, there is less wasted energy in driving the valve train.

BRIEF SUMMARY

The valve system discussed herein and shown in the figures address the deficiencies known in the art, discussed above and those below.

The valve system disclosed herein may have a follower that extends from a lifter end portion of the rocker. The follower may have a curved inner surface which interacts with a nose of a cam lobe to push the rocker upward or away from a valve stem of the valve. Primarily, but not necessarily exclusively, the nose of the cam lobe pushes the follower and the rocker upward such that (1) the follower primarily moves the mass of the rocker and (2) the spring disposed about the valve stem of the valve primarily works to traverse the mass of the valve from the opened position to the closed position. Accordingly, the movement of the rocker and the valve may be caused by a combination of (1) the cam lobe pushing the follower and rocker upward and (2) the spring pushing the valve to the closed position.

In a first embodiment of the system, the valve end portion of the rocker may be in contact with the valve stem but not engaged thereto. During rotation of the cam lobe, the cam lobe pushes up on the follower member which traverses the rocker away from the valve stem. Preferably, the rocker may be pushed away from the valve stem at a rate faster than the rate the spring can push the valve to the closed position. In this manner, the cam lobe pushes the follower member and the rocker. The rocker does not contact the valve stem as the rocker is pivoted up. Also, the spring may solely be used to close the valve to the closed position. The spring disposed about the valve stem may be sized and configured to prevent valve float. Alternatively, it is also contemplated that the cam lobe may push up on the follower member to traverse the valve end portion of the rocker at the same or slightly less rate compared to the rate at which the spring traverses the valve to the closed position. In this manner, the valve stem generally maintains contact with the valve end portion of the rocker as the valve is traversed to the closed position. Nonetheless, the cam lobe primarily traverses the rocker upward, whereas, the spring primarily traverses the valve to the closed position.

In a second embodiment of the system, the valve end portion of the rocker may be connected to the valve stem of the valve with a valve stem keeper. The valve stem keeper may be spring loaded such that the rocker may continue to pivot upward after the valve head is seated onto the valve seat to ensure that the valve head is seated on the valve seat and to allow the valve to remain closed for a duration of time. A spring disposed about the valve stem holds the valve closed when the nose of the cam lobe releases the follower member.

In a third embodiment of the system, the valve end portion of the rocker may be connected to the valve stem with a non-spring loaded keeper. In this embodiment, the cam lobe may push up on the follower member until the valve is almost closed (or slightly opened). A curved inner surface of the follower member may then trace the circular path of the cam lobe. In this manner, the cam lobe does not finish closing the valve to the closed position. Rather, the spring disposed about the valve stem may push the valve stem and slightly pivot the rocker upward to close the valve. The spring also keeps the valve closed when the nose of the cam lobe releases the follower.

In a fourth embodiment of the system, the same may correspond to the first embodiment except that the follower member may be attached to both the lifter end portion as well as the valve end portion. The nose of the cam lobe stays in contact with the curved inner surface of the follower member longer to hold the rocker up for a longer duration of time.

In a fifth embodiment of the system, the same correlates to the second embodiment discussed herein except that the follower member is attached to both the lifter end portion as well as to the valve end portion of the rocker. In this embodiment, the weaker spring disposed about the valve stem may be optional. The nose of the cam lobe may stay in contact with the curved inner surface of the follower member to hold the rocker upward for a longer duration of time and maintain the valve in the closed position for a sufficient amount of time. Thereafter, the nose of the cam lobe contacts the contact surface of the rocker to begin pushing the rocker downward.

In a sixth embodiment of the system, the same may correspond to the third embodiment discussed herein. The follower member may be attached to both the lifter end portion as well as to the valve end portion of the rocker to hold the rocker upward for a longer duration of time.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

FIGS. 1-5 are side cross sectional views of an engine that desmodromically pivots a rocker 14 away from a valve stem 16 to allow a spring 18 that is weaker than a traditional spring to close the valve 12. Since the spring 18 is weaker than a traditional spring, more energy may be directed to creating output power instead of overcoming the spring. The system shown in FIGS. 1-5 as well as the other systems discussed herein may be incorporated into modern engine designs currently in existence, yet to be manufacturer, or provided as a retrofit kit to be used on existing head designs, such as used in conventional V8's, V6's, V10's, inline 4's, inline 6's and the like. The system may also be utilized with gasoline type engines or diesel engines. More generally, the various aspects of the system may be utilized in various engine designs which use poppet valves. It is appreciated that the system discussed herein may be installed and/or retrofitted to fit on many other conventional heads that have been previously manufactured or which are currently being manufactured for numerous engine manufacturers. Additionally, the systems discussed herein may be integrated into specially designed heads. Thus, the scope of the systems discussed herein should not be limited to the exemplary embodiments disclosed herein. Rather, the exemplary embodiments of the system disclosed herein should be viewed merely as one of many embodiments which may utilize the concepts disclosed herein.

Figure 1:
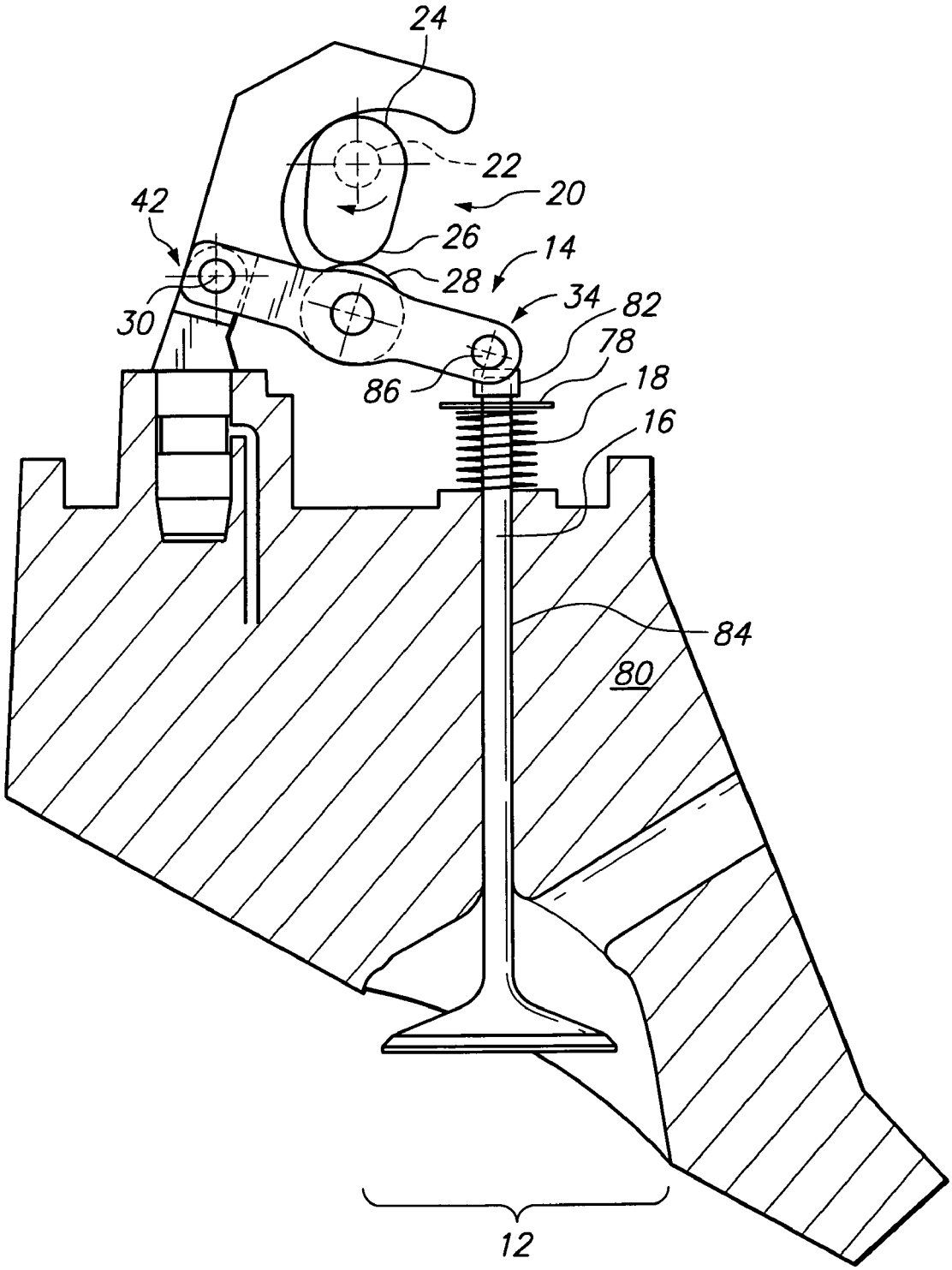
FIG. 1 is a cross sectional view of an engine illustrating a first embodiment of a system for desmodromically opening a valve and desmodromically pivoting a rocker with a cam lobe at about a 6 o'clock position.

FIGS. 1-4 illustrate the opening and closing of a valve 12 as a cam lobe 20 rotates under a power of a rotating shaft 22. In FIG. 1, the cam lobe 20 which defines a base circle 24 and a nose 26 is shown located at about the 6 o'clock position. In this position, the nose 26 of the cam lobe 20 contacts a contact surface 28 of the rocker 14. In FIGS. 1-5, the contact surface 28 is a roller. However, it is also contemplated that the contact surface 28 may be a smooth surface which interacts with the cam lobe 20. The nose 26 of the cam lobe 20 pivots the rocker 14 about a rocker pivot axis 30 defined at a lifter end portion 32 of the rocker 14. A valve end portion 34 also pushes downwardly on a valve stem 16 of the valve 12.

Figure 2:
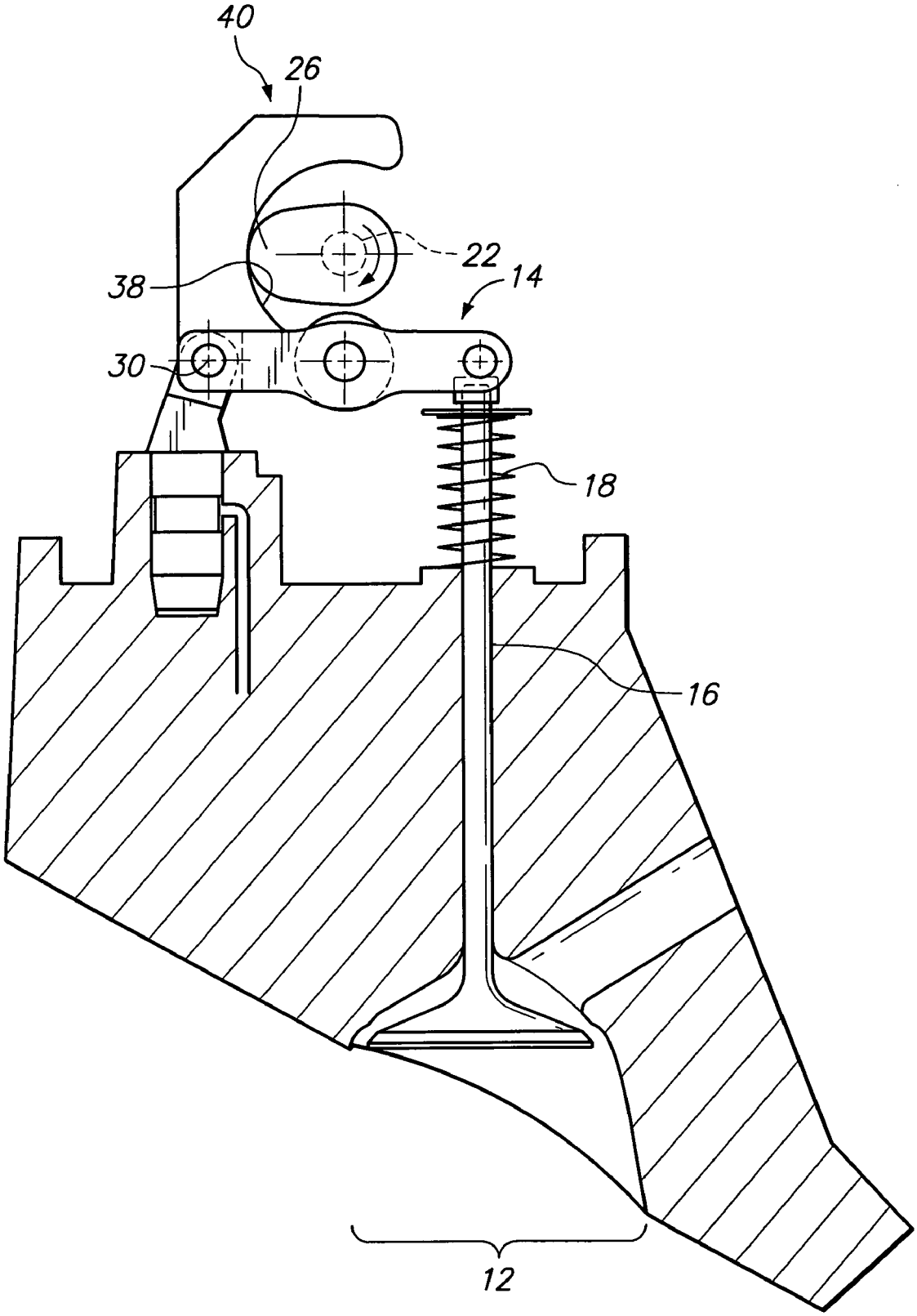
FIG. 2 is a side cross sectional view of the engine shown in FIG. 1 with the cam lobe shown at about the 9 o'clock position.

The cam lobe 20 and the rotating shaft 22 rotates in a clockwise direction as shown in FIGS. 1-4. The cam lobe 20 continues to rotate in the clockwise direction and eventually contacts a curved inner surface 38 of a follower member 40, as shown in FIG. 2. The curved inner surface may have a circular configuration but other configurations are also contemplated. The nose 26 of the cam lobe 20 contacts the curved inner surface 38 of the follower member 40 and begins to push the follower member 40 upward and pivot the rocker 14 about pivot axis 30 in the counterclockwise direction away from the valve 12. The spring 18 disposed about the valve stem 16 pushes the valve stem 16 and the valve 12 toward a closed position (see FIG. 3). Preferably, the spring 18 does not push the rocker 14 in the counterclockwise direction. The nose 26 of the cam lobe 20 may push the follower 40 and the rocker 14 at a rate faster than the rate the spring 18 can push the valve upward. Accordingly, the cam lobe 20 primarily pushes the rocker 14 up. Also, the spring 18 primarily pushes the valve 12 to the closed position. It is also contemplated that the spring 18 may aid in pivoting the rocker 14 in the counterclockwise direction minimally but a majority of the effort to rotate or pivot the rocker 14 in the counterclockwise direction is performed by the nose 26 of the cam lobe 20 pushing up on the curved inner surface 38 of the follower member 40. By way of example and not limitation, the cam lobe 20 may push the follower 40 and the rocker 14 at the same rate or slightly less than the rate that the spring 18 pushes the valve 12 to the closed position. The spring 18 is primarily used to traverse the valve 12 from the open position (see FIG. 1) to the closed position (see FIG. 3). The cam lobe 20 primarily traverses the rocker 14 up.

Figure 3:
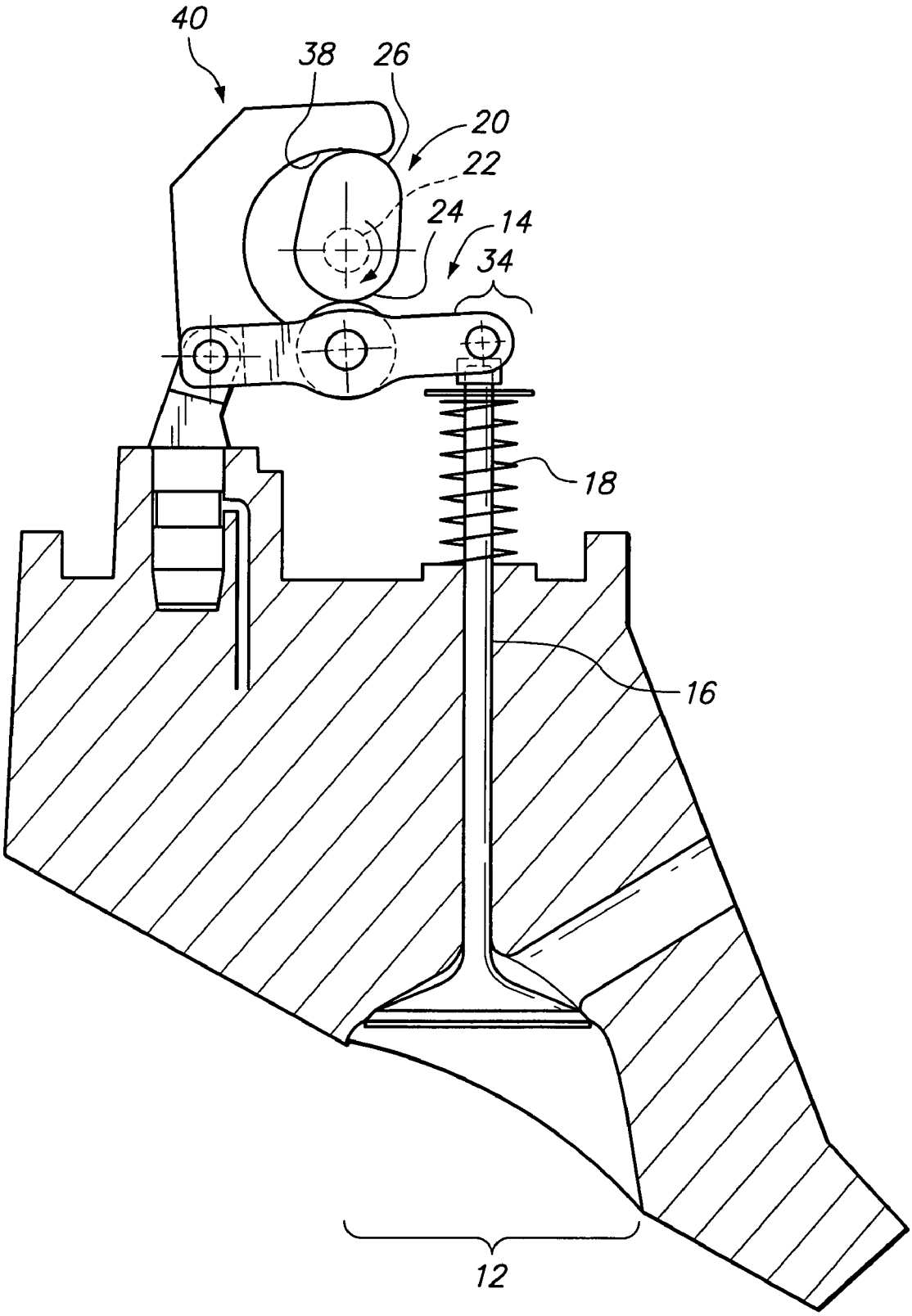
FIG. 3 is a side cross sectional view of the engine shown in FIG. 1 with the cam lobe at about the 12 o'clock position.

Preferably, as the cam lobe 20 rotates, the nose 26 of the cam lobe 20 pushes the curved inner surface 38 of the follower member 40 until the valve end portion 34 of the rocker 14 is not in contact with the valve stem 16 when the valve 12 is in the closed position. Referring now to FIG. 3, although the valve end portion 34 of the rocker 14 appears to be in contact with the valve stem 16, it is contemplated that the valve end portion 34 of the rocker 14 may be at least slightly gapped away from the valve stem 16. Accordingly, the nose 26 of the cam lobe 20 and the curved inner surface 38 of the follower member 40 may be sized such that the rocker 40 has an over travel. The spring 18 is used to traverse the mass of the valve 12 to the closed position. The spring does not pivot the mass of the rocker in the counterclockwise direction. Accordingly, the spring 18 may be lighter than traditional springs which traverse both the rocker 14 and the valve 12 to close the valve 12. Hence, more energy is directed to creating output power than overcoming the traditionally strong spring.

Alternatively, the nose 26 of the cam lobe 20 and the curved inner surface 38 of the follower member 40 may be sized such that at the cam lobe's peak position, the valve end portion 34 of the rocker 14 may still be in contact with the valve stem 16. In this example, the cam lobe 20 does most of the work to pivot the rocker 14 in the counterclockwise direction away from the valve stem 16. The spring 18 may push the valve 12 and the rocker 14 to the closed position a small distance. By way of example and not limitation, the cam lobe 20 pushes the follower 40 and the rocker 14 upward until the valve 12 is almost closed. The valve stem 16 may still be in contact with the valve end portion 34 of the rocker 14. There may be a gap between the base circle of the cam lobe and the contact surface 28. The spring 18 may be used to complete closure of the valve 12. Due to the small distance to close the valve 12, a lighter weight spring 18 may still be sufficiently strong to close the valve 12 and to prevent valve float.

Figure 4:
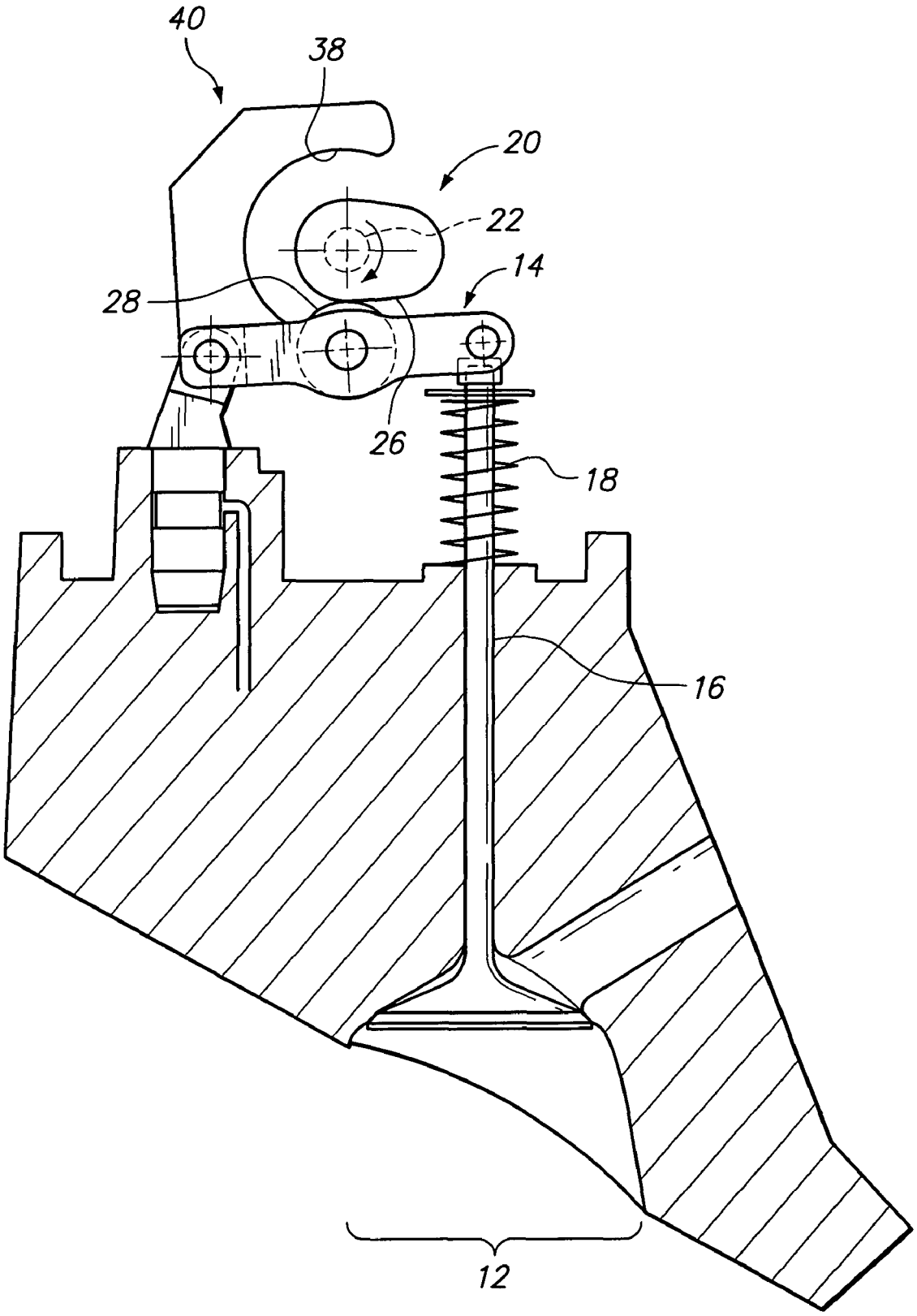
FIG. 4 is a side cross sectional view of the engine shown in FIG. 1 with the cam lobe at about the 3 o'clock position.

As the cam lobe 20 continues to rotate, the nose 26 of the cam lobe 20 disengages the curved inner surface 38 of the follower member 40, as shown in FIG. 4. The spring 18 holds the valve 12 in the closed position until the nose 26 of the cam lobe 20 begins to contact the contact surface 28 of the rocker 14. At this point, the nose 26 of the cam lobe 20 pushes the rocker 14 downward and in a clockwise direction and also pushes the valve 12 toward the open position against the spring force of spring 18. The cam lobe 20 continues to rotate in the clockwise direction until the nose 26 pushes the rocker 14 to its lowest position. The above-mentioned cycle is repeated.

It is contemplated that the curved inner surface 38 may be sized and configured to permit the valve 12 to be closed earlier or later during the valve cycle discussed above. For example, when the cam lobe 20 is at about the 6 o'clock position, the cam lobe 20 may rotate in the clockwise direction. The nose 26 of the cam lobe 20 may contact the curved inner surface 38 of the follower member 40. The nose 26 of the cam lobe 20 may quickly or slowly rotate or pivot the rocker 14 upward to an upper most position. Preferably, once the rocker 14 is pivoted to the upper most position, the curved inner surface 38 of the follower 40 may then generally have a generally circular configuration that traces the travel path of the nose 26 of the cam lobe 20.

Figure 5:
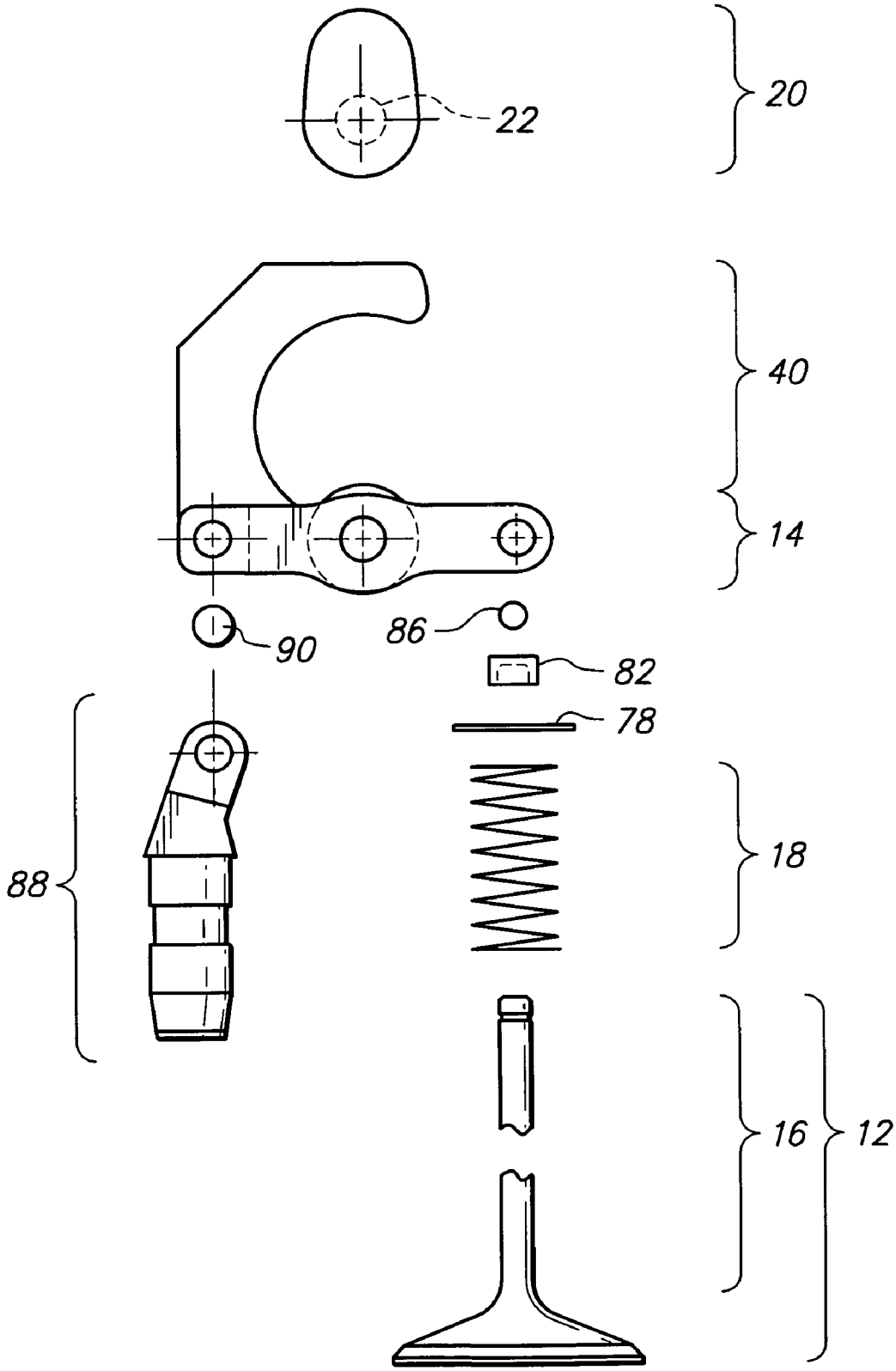
FIG. 5 is an exploded side cross sectional view of the system shown in FIGS. 1-4.

Referring now to FIG. 5, an exploded view of the system shown in FIGS. 1-4 is illustrated. It is contemplated that the rocker 14 may be a traditional rocker as implemented in traditional spring actuated valves. The follower member 40 may be an add-on part that can be retrofitted onto traditional rockers 14. Weaker springs 18 would replace the traditional strong spring so as to gain additional horse power. The follower member 40 may be attached to the lifter end portion 32 of the rocker 14 such as by nut and bolt connection, pin connection or other connections that are known in the art or developed in the future. The spring 18 may be disposed between a washer 78 (see FIGS. 1 and 5) and the engine block 80 (see FIG. 1). The washer 78 may be held in place by an end cap 82. To assemble the spring 18 onto the valve stem 16, the valve stem 16 may be pushed through a valve guide 84 (see FIG. 1) of the engine. The spring 18 may be disposed about the valve stem 16. The washer 78 may then be pushed on top of the spring 18. The end cap 82 may be attached (e.g., snapped) onto the valve stem 16. The upper surface of the end cap 82 may slide upon a pin 86 as the rocker 14 pivots up and down during the valve cycle. The rocker 14 may additionally be attached to a lifter 88 via a pin 90.

Figure 6:
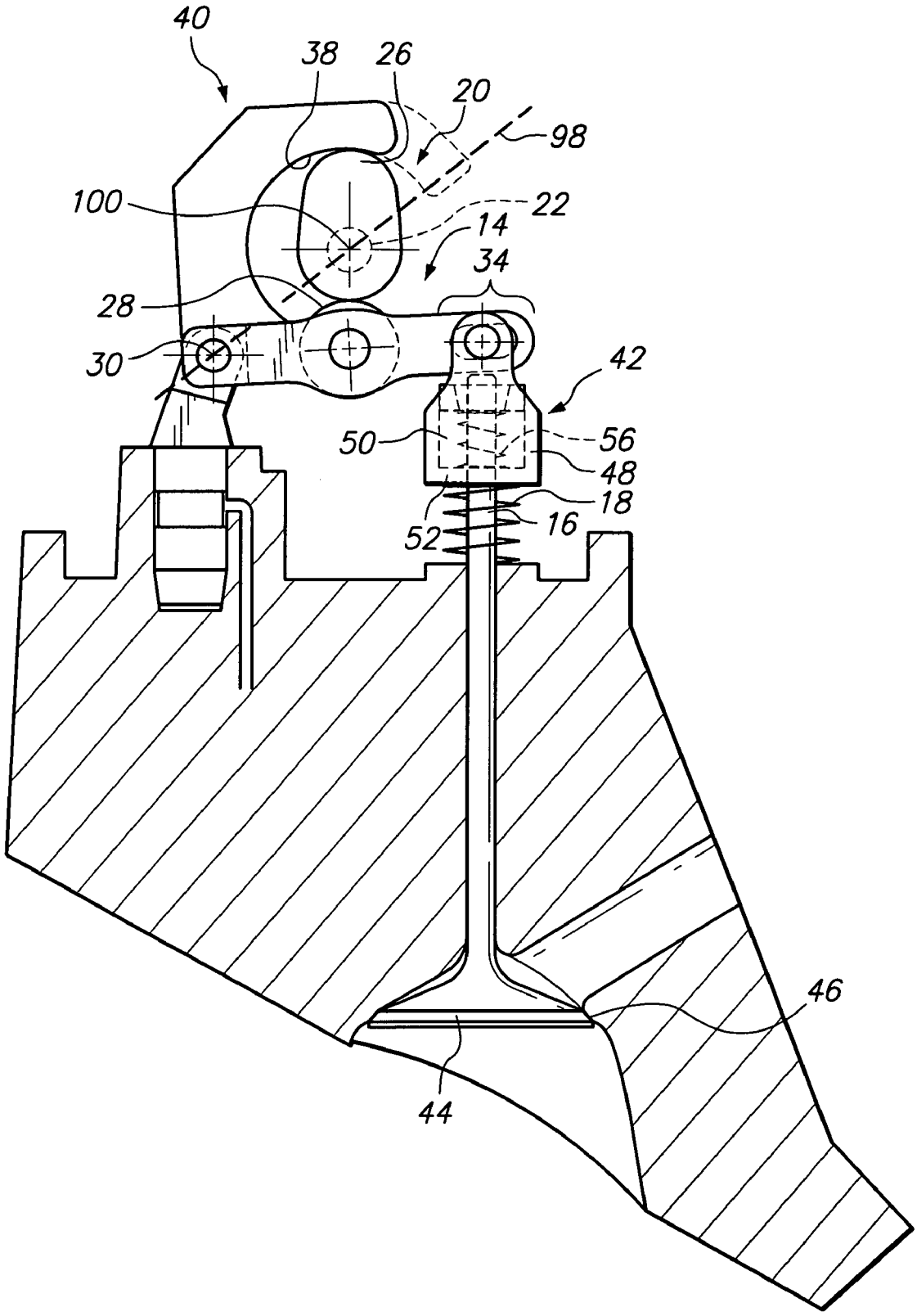
FIG. 6 is a side cross sectional view of an engine illustrating a second embodiment of the system with the cam lobe at about the 12 o'clock position.
Figure 7:
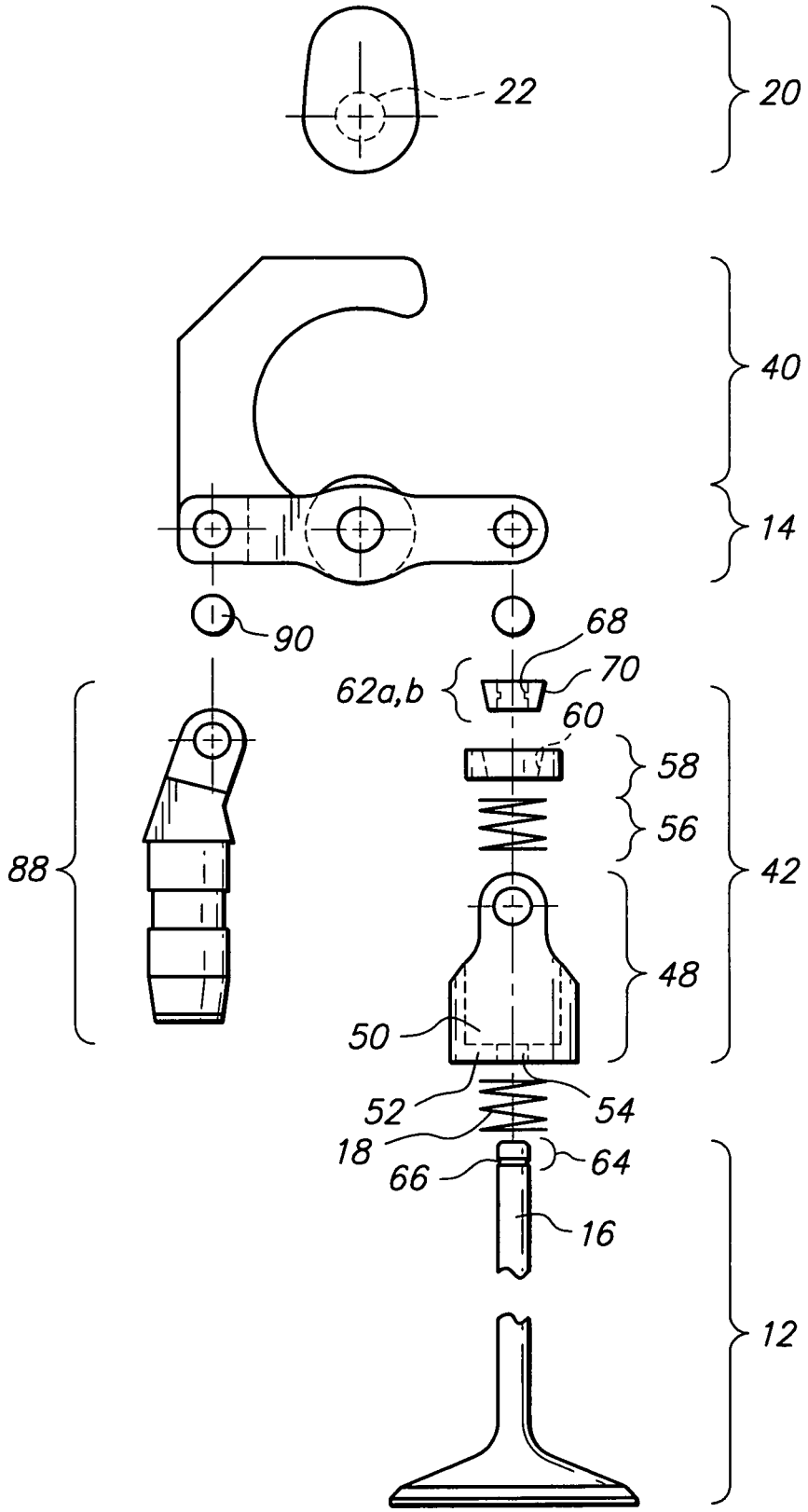
FIG. 7 is a side cross sectional view of the system shown in FIG. 6.

Referring now to FIGS. 6 and 7, FIG. 6 is a cross sectional view of an engine illustrating a second embodiment of the system. In this embodiment, the valve end portion 34 of the rocker 14 is connected to the valve stem 16 of the valve 12 with a valve stem keeper 42. The valve stem keeper 42 may be spring loaded to allow the valve head 44 to remain seated on the valve seat 46 as the rocker continues to be pivoted upward after the valve head is seated on the valve seat. By way of example and not limitation, after the valve head is seated on the valve seat, the rocker may continue to be traversed upward to ensure that the valve is closed and to maintain the valve 12 in a closed position for a certain duration of time. The valve stem keeper 42 permits the valve head 44 to remain seated onto the valve seat 46 without breaking the valve stem 16.

A body 48 of the valve stem keeper 42 may have a generally cylindrical configuration with a hollowed out center 50. A bottom end portion of the body 48 of the valve stem keeper 42 may have a ledge 52 with an aperture 54 sized and configured to receive the valve stem 16. The valve stem keeper 42 may have a spring 56 disposed within the hollowed out center 50 of the body 48 which biases the valve 12 to a retracted position. The valve stem keeper 42 may additionally have a washer 58. The ledge 52 of the valve stem keeper 42 and the washer 58 sandwiches the spring 56 within the hollowed out center 50 of the body 48. The washer 58 may have a flattened bottom sized and configured to press against the spring 56. Additionally, the washer 58 may have an inverted frusto conical surface 60. To attach the valve stem 16 to the valve stem keeper 42, an upper distal end portion 64 of the valve stem 16 may have a groove 66. The inner surface of first and second retaining clips or members 62*a, b* may have a corresponding ridge 68. The valve stem 16 may initially be inserted through the aperture 54 of the body 48, the spring 56 and the washer 58. The first and second retaining clips 62*a, b* may be disposed about the upper distal end portion 64 of the valve stem 16 with the ridge 68 of the first and second retaining clips 62*a, b* received into the groove 66 of the upper distal end portion 64 of the valve stem 16. The upper distal end portion 64 and the first and second retaining clips 62*a, b* are lowered until an exterior frusto conical surface 70 of the first and second retaining clips 62*a, b* contacts and mates with the frusto conical surface 60 of the washer 58. The valve stem 16 may be pulled to seat the spring 56 between the washer 58 and the ledge 52. The valve 12 is now biased to the retracted position.

As the cam lobe 20 rotates in the clockwise direction, the nose 26 of the cam lobe 20 contacts the curved inner surface 38 of the follower member 40 and pushes the rocker 14 up and the valve 12 via the valve stem keeper 42 toward the closed position. The spring 18 may optionally aid in closing the valve 12 by pushing up on the ledge 52 of the body 48. Prior to the nose 26 of the cam lobe 20 reaching its peak position, the valve head 44 may seat onto the valve seat 46 thereby closing the valve 12. The cam lobe 20 may continue to rotate and push the rocker upward to ensure that the valve head 44 is seated onto the valve seat 46. Thereafter, the curved inner surface 38 of the follower member 40 may follow or trace the circular path of the nose 26 of the cam lobe 20. As the cam lobe 20 continues to rotate, the nose 26 of the cam lobe 20 approaches its peak position. The spring 56 within the valve stem keeper 42 compresses to maintain the valve 12 in the closed position without breaking the valve stem 16. The spring 56 provides the slack within the system to ensure that the valve head is seated on the valve seat and to allow the valve 12 to remain closed for a required duration of time.

After the nose 26 of the cam lobe 20 disengages the curved inner surface 38 of the follower member 40, the spring 18 holds the valve 12 in the closed position until the cam lobe 20 pushes the contact surface 28 to traverse the rocker 14 downward and the valve toward the opened position.

Figure 8:
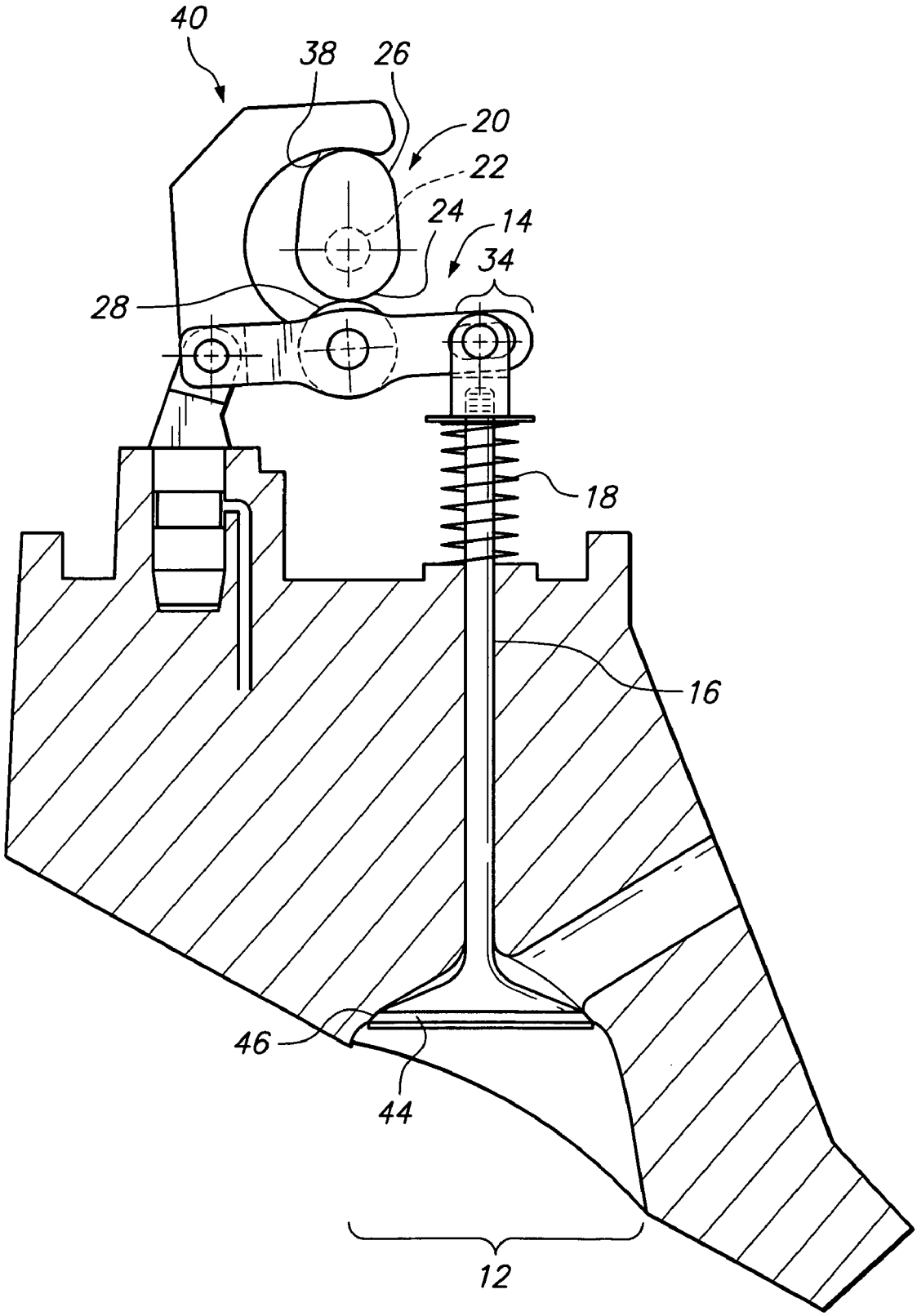
FIG. 8 is a side cross sectional view of an engine illustrating the system with the cam lobe at about the 12 o'clock position.
Figure 9:
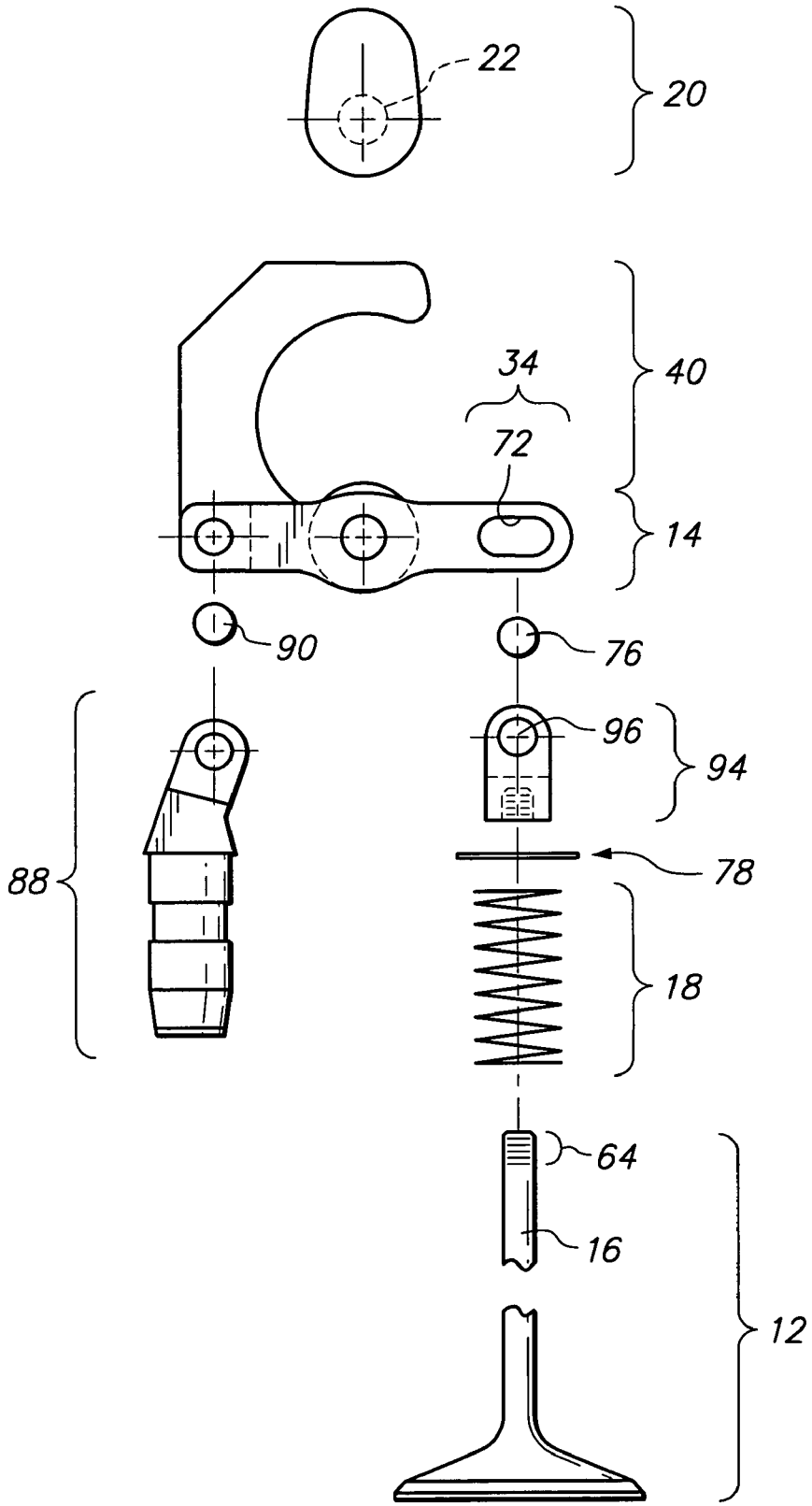
FIG. 9 is an exploded side cross sectional view of the system shown in FIG. 8.
Figure 10:
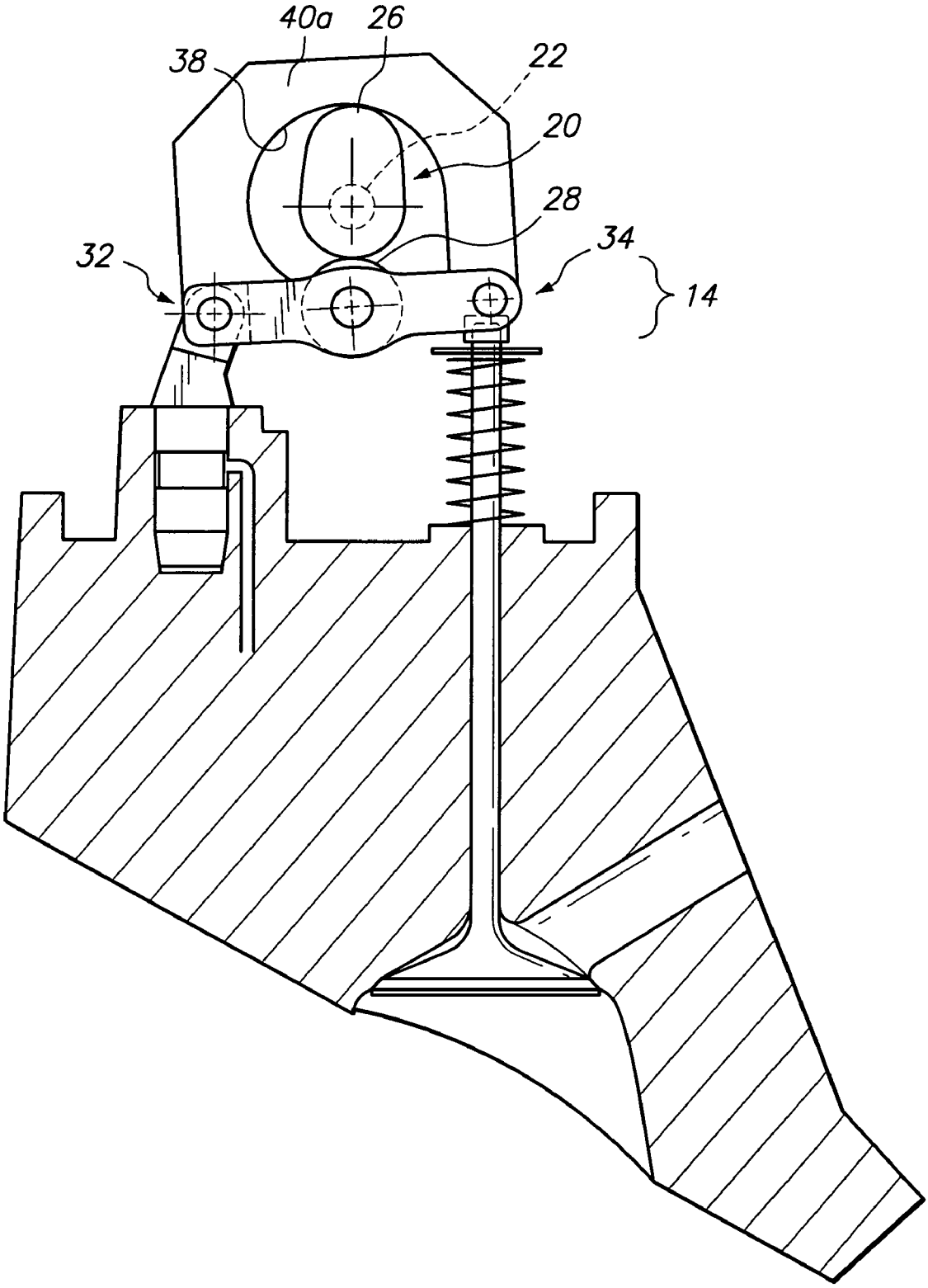
FIG. 10 is a side cross sectional view of an engine that illustrates a fourth embodiment of the system with a full sized follower.

Referring now to FIGS. 8 and 9, a cross sectional view of an engine illustrating a third embodiment of the system is shown. The valve end portion 34 may be fixedly attached to the valve stem 16 of the valve 12. The rocker 14 pivots upward under the power of the nose 26 of the cam lobe 20 pushing up on the curved inner surface 38 of the follower member 40 until the valve 12 is substantially closed. By way of example and not limitation, the valve head 44 may be approximately 0.005"-0.010" away from the valve seat 46. The contact surface 28 may be gapped away from the base circle 24 of the cam lobe 20 such that the spring 18 can push the rocker 14 upward and complete closure of the valve 12.

More particularly, as the cam lobe 20 rotates in the clockwise direction from about the 6 o'clock position, the nose 26 of the cam lobe 20 contacts the curved inner surface 38 of the follower member 40. The cam lobe 20 pushes the follower member 40 and the rocker 14 upward to traverse the rocker 14 up and the valve 12 toward the closed position. When the valve head 44 is close to (e.g., 0.005" or 0.010" away) to the valve seat 46, the curved inner surface may begin to trace the circular path of the nose 26 of the cam lobe 20. Accordingly, at this point, the rocker 14 does not pivot upward under the power of the cam lobe 20. Alternatively, at this point, the follower may be truncated. The base circle 24 may be gapped away from the contact surface 38 to allow the spring 18 to complete closure of the valve 12 by pushing the rocker 14 and the valve 12 upward. When the valve 12 is closed, the nose 26 of the cam lobe 20 may or may not contact the curved inner surface 38. The reason is that the spring 18 pushes the rocker 14 as well as the follower member 40 upward to complete closure of the valve 12.

As shown in FIG. 9, the valve end portion 34 of the rocker 14 may have a horizontally slotted hole 72. The upper distal end portion 64 of the valve stem 16 may be attached to a non-spring loaded keeper 94. The upper distal end portion 64 of the valve stem 16 may be attached to the lower portion of the keeper 94. The keeper 94 may also have a hole 96 sized and configured to a receive a pin 76. To attach the valve stem 16 to the rocker 14, the spring 18 and the washer 78 may be disposed about the valve stem 16. The upper distal end portion 64 may be fixedly engaged to the keeper 94. The hole 96 may be aligned to the slotted hole 72. The pin 76 may now be fixedly received into the slotted hole 96 and slidingly received into slotted hole 72. The pin 76 slides within the slotted hole 72 as the rocker 14 pivots up and down.

Figure 11:
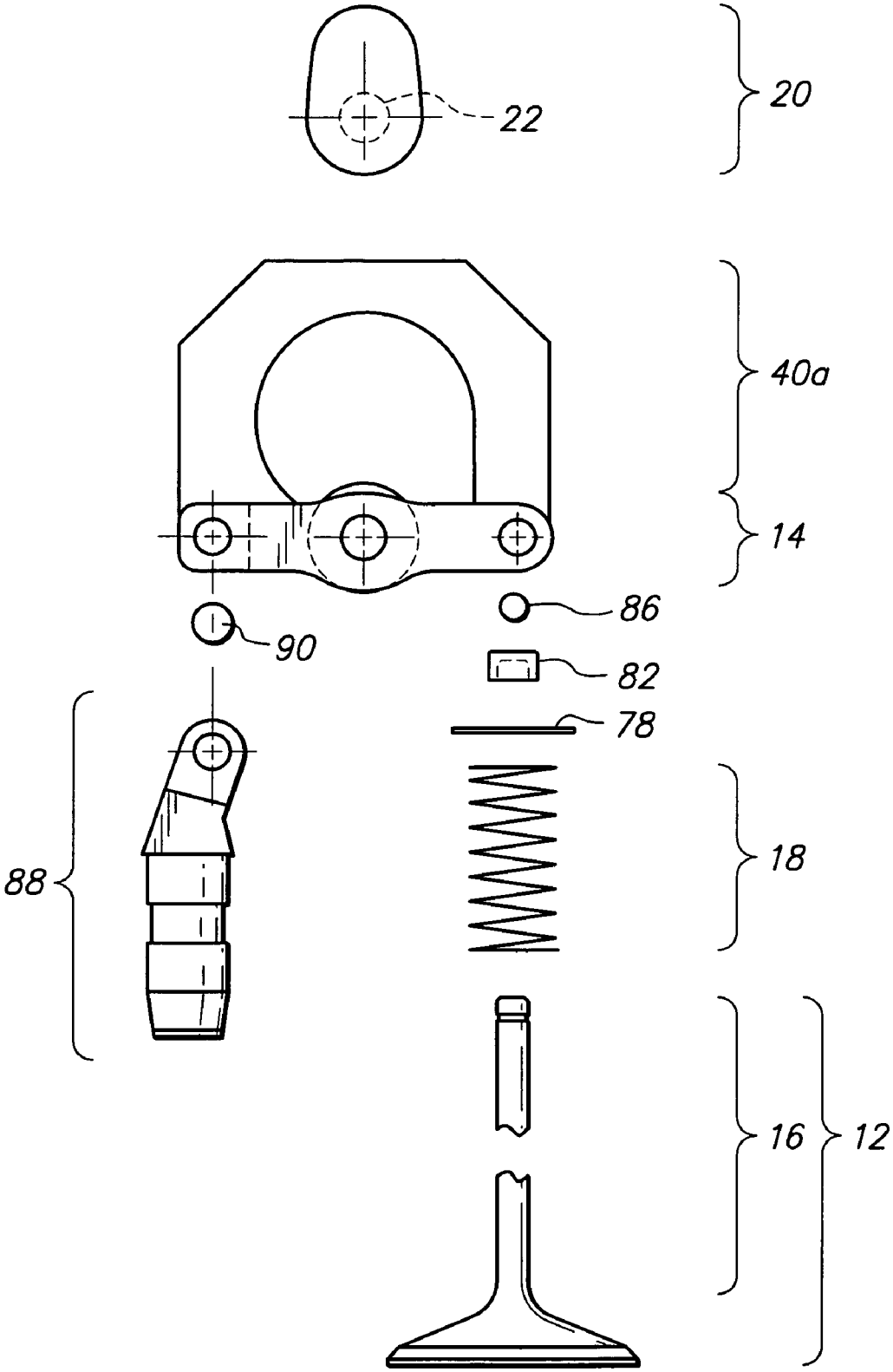
FIG. 11 is an exploded side cross sectional view of the engine shown in FIG. 10.

Referring now to FIGS. 10-15, embodiments four, five and six of the system are shown. These embodiments respectively correlate to the first through third embodiments depicted in FIGS. 1-9. The embodiment shown in FIGS. 10 and 11 correlates to the embodiment shown in FIGS. 1-5, except that the follower 40*a* is attached to both the lifter end portion 32 and also the valve end portion 34 of the rocker 14. The nose 26 of the cam lobe 20 may maintain contact with the curved inner surface 38 for a longer duration of time compared to the first embodiment depicted in FIGS. 1-5 to lift the rocker 14 upward for a longer duration of time. By way of example and not limitation, the nose 26 of the cam lobe 20 may release the curved inner surface 38 when the nose 26 of the cam lobe 20 begins to contact the contact surface 28 of the rocker 14. As shown in FIG. 11, the valve stem 16 may be attached to the rocker 14 in a similar manner compared to the embodiment shown in FIGS. 1-5.

In the fourth, fifth and sixth embodiments, it is contemplated that the follower 40*a* may be attached to the lifter end portion 32 and also the valve end portion 34 of the rocker 14 by any method known in the art such as nut and bolt, pinned connection, etc. The follower 40*a* may be retrofitted on a traditional rocker to incorporate the systems disclosed herein on existing engines. It is also contemplated that the follower member 40*a* may be unitarily formed with the rocker 14.

Figure 12:
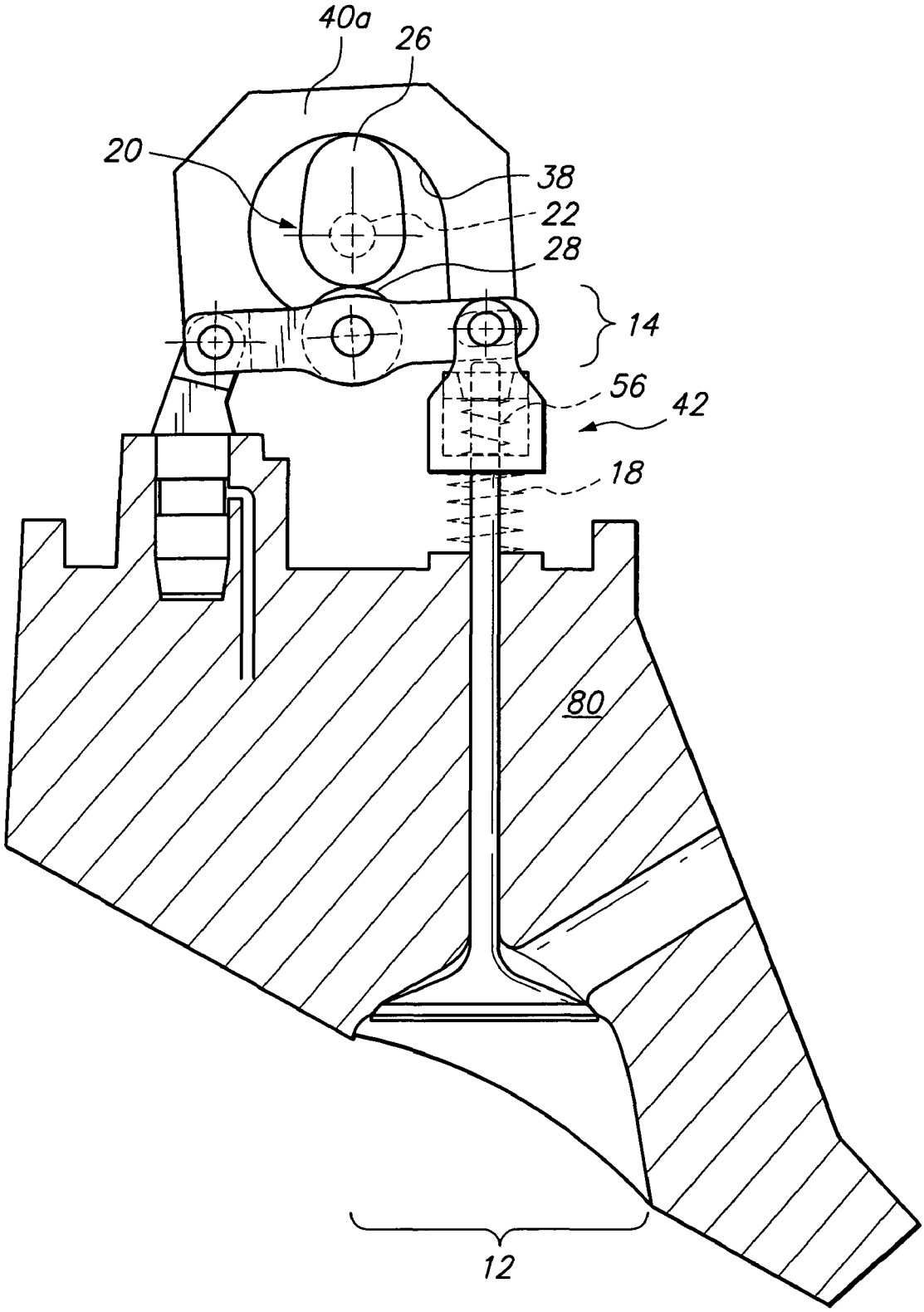
FIG. 12 is a side cross sectional view of an engine illustrating a fifth embodiment of the system having a full follower.
Figure 13:
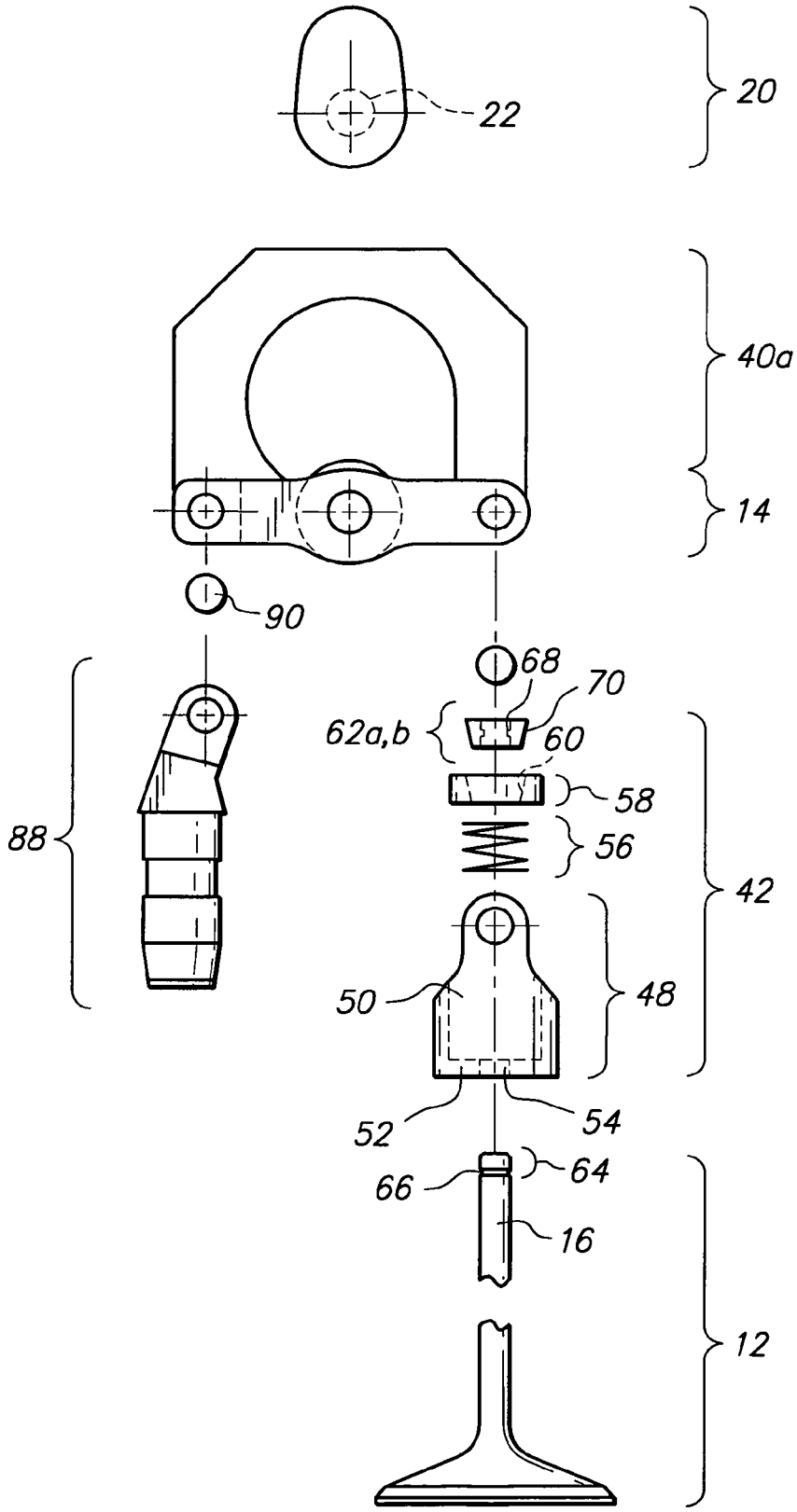
FIG. 13 is an exploded side cross sectional view of the engine shown in FIG. 12.

The embodiment shown in FIGS. 12 and 13 corresponds substantially to the embodiment discussed above in relation to FIGS. 6 and 7. However, the embodiment shown in FIGS. 12 and 13 does not require the spring 18. The spring 18 may be optionally included. The reason is that the nose 26 of the cam lobe 20 maintains contact with the curved inner surface 38 to lift the rocker 14 for a longer duration of time and keep the valve 12 closed. By way of example and not limitation, the nose 26 of the cam lobe 20 may maintain contact with the curved inner surface 38 until sometime before the valve is fully retracted into the valve stem keeper. When the cam lobe 20 releases the follower 40*a* the slack created by the spring 56 within the valve stem keeper 42 may begin to decompress. The valve 12 still remains closed during the decompression of the spring 56. When the valve is retracted in the valve stem keeper, the nose 26 of the cam lobe 20 may be pushing down on the contact surface 28 of the rocker 14 to open the valve 12. As shown in FIG. 13, the valve stem 16 of the valve 12 may be attached to the rocker 14 in substantially the same manner as the embodiment of the system depicted in FIGS. 6 and 7.

Figure 14:
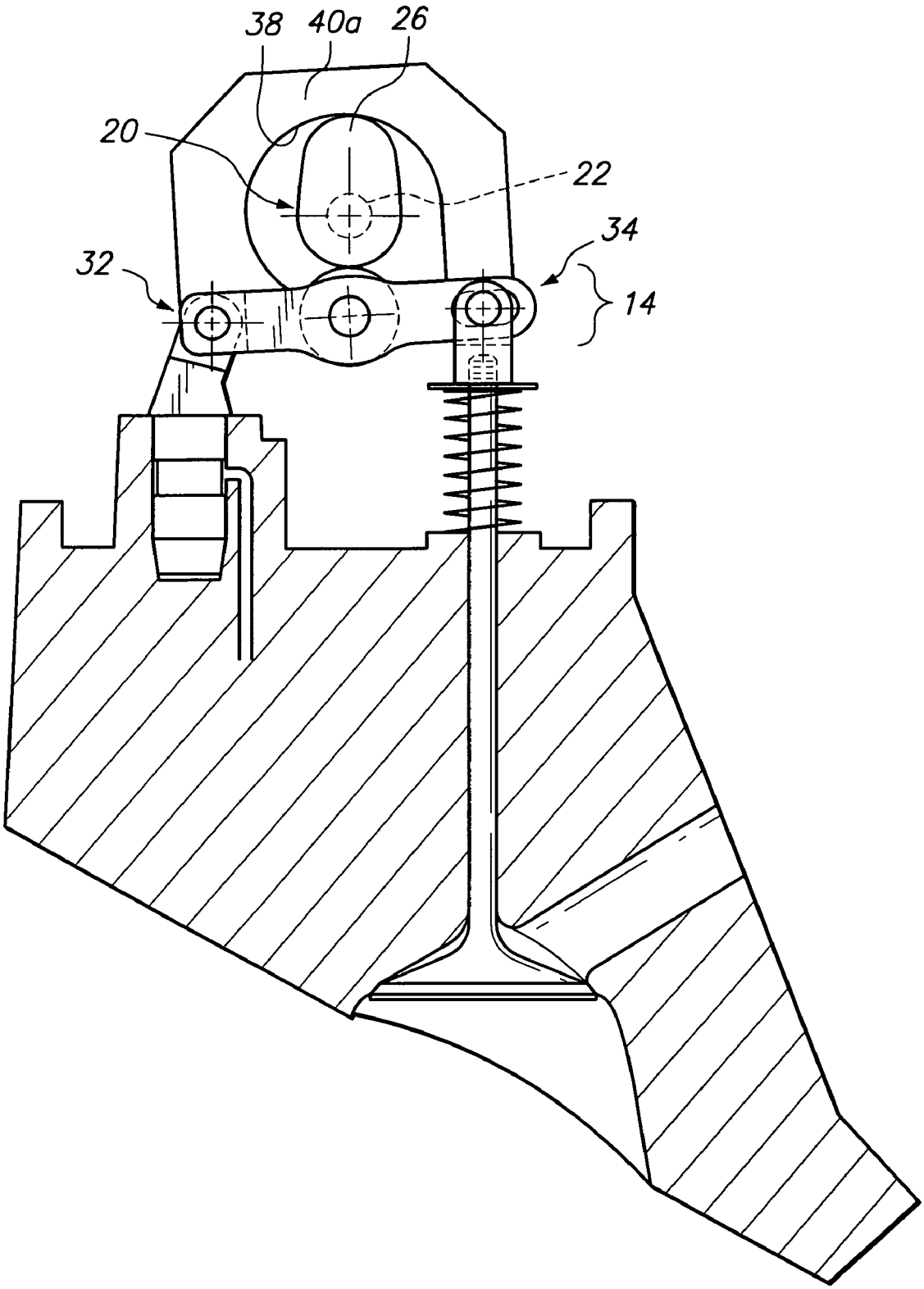
FIG. 14 is a side cross sectional view of an engine illustrating a sixth embodiment of the system with a full follower.
Figure 15:
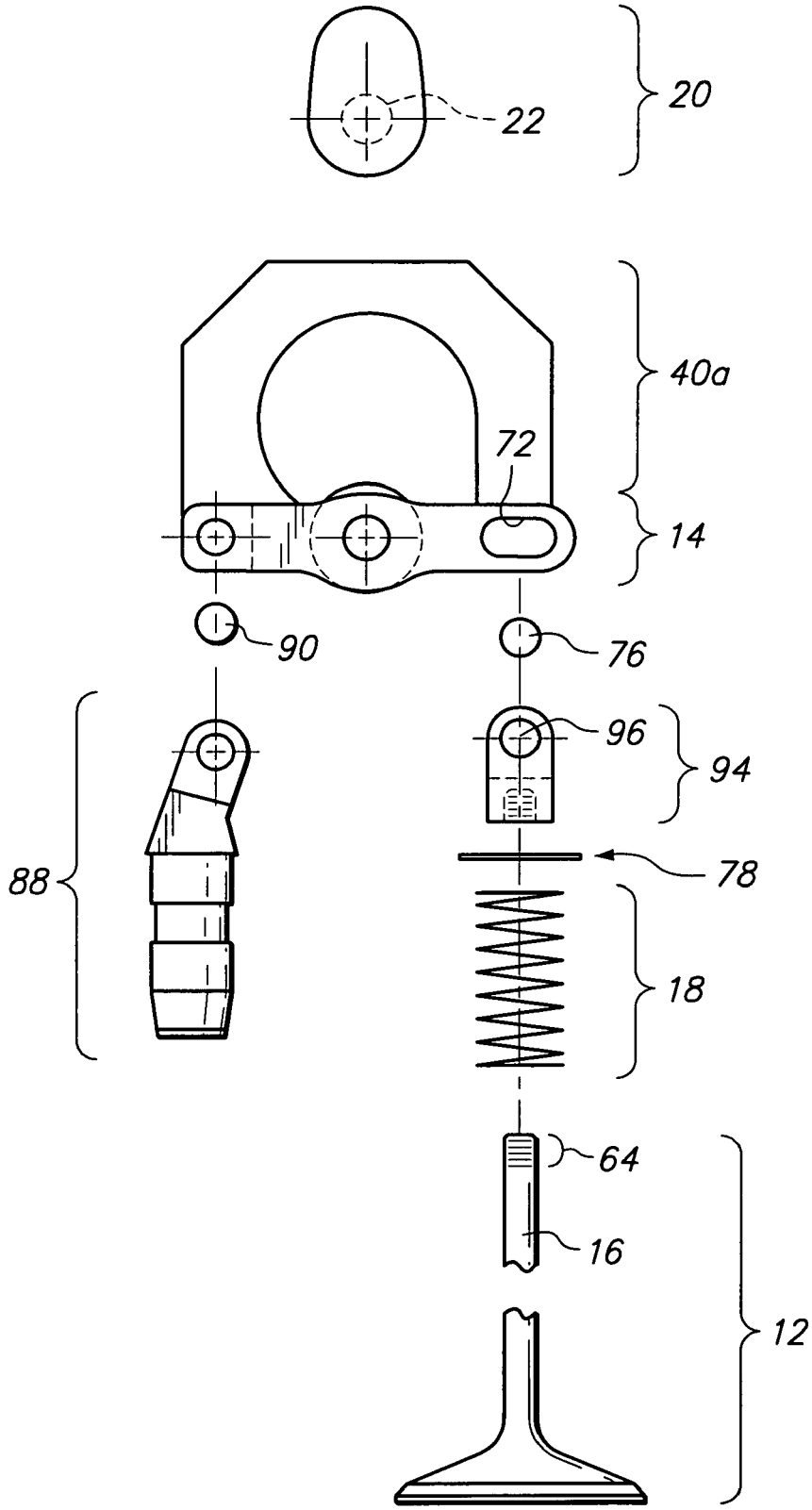
FIG. 15 is an exploded side cross sectional view of the engine shown in FIG. 14.

Referring now to FIGS. 14 and 15, the follower 40*a* is attached to both the lifter end portion 32 and the valve end portion 34 of the rocker 14. The embodiment shown in FIGS. 14 and 15 behave substantially similar to the embodiment discussed above in relation to FIGS. 8 and 9. In the embodiment shown in FIGS. 14 and 15, the nose 26 of the cam lobe 20 maintains contact with the curved inner surface 38 of the follower 40*a* for a longer duration of time.

In an aspect of the first, second and third embodiments discussed in relation to FIGS. 1-9, the curved inner surface 38 of the follower member 40 may extend beyond at least the center of the rotating shaft 22 when the rocker 14 is in the up position. It is further contemplated that the curved inner surface 38 of the follower member 40 may extend to at least the intersection of a line drawn from the pivot axis 30 through the center of the rotating shaft 22. In this regard, the follower member 40 may behave substantially similar to the follower member 40*a* discussed in relation to the fourth through sixth embodiments depicted in FIGS. 10-15.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An engine having a rotating shaft comprising:

a valve comprising a valve stem;

a cam lobe having a base circle and a nose, the cam lobe attached to the rotating shaft;

a rocker having a valve end portion contacting the valve, a lifter end portion defining a pivot axis of the rocker and a cam surface disposed between the valve end portion and the lifter end portion, the nose of the cam lobe contacting the cam surface for opening the valve of the engine;

a follower member disposed adjacent the cam lobe opposite from the rocker, the follower member attached to the rocker, the follower member having a curved inner surface, the nose of the cam lobe contacting the curved inner surface for lifting the rocker;

a spring disposed about the valve stem of the valve for closing the valve.

2. The engine of claim 1 wherein the valve stem of the valve is removeably contactable with the valve end portion of the rocker.

3. The engine of claim 2 wherein the curved inner surface of the follower member and the nose of the cam lobe are sized to disengage the rocker from the valve stem of the valve when the valve is closed.

4. The engine of claim 3 wherein the follower member is attached to the lifter end portion of the rocker and gapped away from the valve end portion of the rocker.

5. The engine of claim 3 wherein the follower member is attached to the lifter end portion and the valve end portion of the rocker.

6. The engine of claim 1 wherein a valve stem of the valve is pinned to a slot at the valve end portion of the rocker to allow pivoting motion of the rocker about the pivot axis and linear travel of the valve stem in a valve guide.

7. The engine of claim 6 wherein the curved inner surface of the follower member and the nose of the cam lobe are sized to substantially close the valve and the spring closes the valve.

8. The engine of claim 6 wherein the follower member is attached to the lifter end portion of the rocker and gapped away from the valve end portion of the rocker.

9. The engine of claim 6 wherein the follower member is attached to the lifter end portion and the valve end portion of the rocker.

10. An engine having a rotating shaft comprising:

a valve having a valve stem;

a spring loaded valve stem keeper attached to the valve stem;

a cam lobe having a base circle and a nose, the cam lobe attached to the rotating shaft;

a rocker having a valve end portion attached to the valve stem keeper, a lifter end portion defining a pivot axis of the rocker and a cam surface disposed between the valve end portion and the lifter end portion, the nose of the cam lobe contacting the cam surface for opening the valve of the engine;

a follower member disposed adjacent the cam lobe opposite to the rocker, the follower member attached to the rocker, the follower member having a curved inner surface, the nose of the cam lobe contacting the curved inner surface for lifting the rocker and traversing the valve toward to the closed position.

11. The engine of claim 10 wherein the curved inner surface of the follower member and the nose of the cam lobe are sized to partially compress a spring in the valve stem keeper after the valve is closed and the rocker continues to be traversed upward.

12. The engine of claim 10 wherein the follower member is attached to the lifter end portion of the rocker and gapped away from the valve end portion of the rocker.

13. The engine of claim 10 wherein the follower member is attached to the lifter end portion and the valve end portion of the rocker.

* * * * *